US008984794B1

(12) United States Patent
Saur

(10) Patent No.: US 8,984,794 B1
(45) Date of Patent: Mar. 24, 2015

(54) TRIGGER GUARD ROLL PIN TOOL

(71) Applicant: Thomas W. Saur, Dearborn, MI (US)

(72) Inventor: Thomas W. Saur, Dearborn, MI (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/224,360

(22) Filed: Mar. 25, 2014

(51) Int. Cl.
*F41C 27/00* (2006.01)

(52) U.S. Cl.
CPC ..... *F41C 27/00* (2013.01)
USPC ..... 42/108

(58) Field of Classification Search
USPC ..... 42/108, 106; 89/1.1; 269/37, 71
See application file for complete search history.

(56) References Cited

U.S. PATENT DOCUMENTS

| | | | | |
|---|---|---|---|---|
| 2,755,541 | A * | 7/1956 | Kruger | 29/268 |
| 3,024,681 | A * | 3/1962 | Sadler, III | 81/3.6 |
| 5,283,936 | A * | 2/1994 | Pickles et al. | 29/268 |
| 5,647,112 | A * | 7/1997 | Arvizu | 29/268 |

* cited by examiner

*Primary Examiner* — Jonathan C Weber
(74) *Attorney, Agent, or Firm* — Michael C. Sachs

(57) ABSTRACT

This trigger guard roll pin tool makes it possible to safely and quickly install or remove the trigger guard roll pin on a conventional M16/M4 family weapon. In the disassembly or reassembly of the trigger guard on such weapons the handling of the trigger guard roll pin element is often a manually challenging and painstaking activity that can result in damage to the weapon if done incorrectly. This disclosed tool handily is an assist in such activities. The trigger guard roll pin tool makes it possible to remove and install the trigger guard roll pin without risking breakage of the roll pin flanges on the lower receiver.

9 Claims, 6 Drawing Sheets

TRIGGER GUARD ROLL PIN TOOL

U.S. GOVERNMENT INTEREST

The inventions described herein may be made, used, or licensed by or for the U.S. Government for U.S. Government purposes.

BACKGROUND AND SUMMARY OF INVENTION

This tool generally makes possible more convenient handling of the removal and installation of a roll pin that retains a trigger guard in a lower receiver on a conventional M16/M4 family weapon when the installation or removal of the trigger guard, hence the installation or removal of the retaining roll pin, is desired. As will be appreciated by those in the gun repair trade, the disassembly or reassembly of the trigger guard and allied elements (e.g., the roll pin) of such weapons is a challenging, tricky and painstaking activity sometimes resulting in damage to the lower receiver, thus greatly needing improved assist. The disclosed tool handily is a great addition and assists in such activities.

The description as follows includes directional designations such as up, down, left, right, lateral, transverse, longitudinal, top, bottom, vertical, and the like, that are taken from the perspective of a firearm (e.g., a conventional AR-10/AR-15/M16 family, style, platform, or pattern rifle and M4 pattern carbine, and variants thereof) as typically held and operated by a user.

The description assumes the level of knowledge held by an ordinary armorer, gunsmith, repair or assembly technician, user, operator, maintenance personnel, and the like for a conventional AR-15/M16 pattern rifle and M4 pattern carbine, and variants thereof, and the respective components and operation thereof. The environment forms no part of the invention. Likewise, designations such as "a", "an", and "the" are not to be construed to be limited to a singular item or action unless apparent from the context or definitely described as such.

As used herein, elements having numbers more than 9 and less than 100 generally refer to conventional elements known in the art by one having ordinary skill with respect to a rifle, firearm, weapon, carbine, and the like; generally AR-10, AR-15/M16 rifle, M4 carbine families; while elements number 100 and above refer to the present invention, or elements, components, and the like thereof. Like numbered elements generally refer to the same element; however, the like numbered elements may include a suffix "L" to designate the left side element and a suffix "R" to designate the right side element when left and right elements are mirrors of each other.

Conventional elements include:

10: lower receiver assembly;
12: trigger guard;
14: trigger guard retention roll pin;
16: pistol grip (hand grip) mounting flange;
20 (20L, 20R): trigger guard retention flange (tang, ear, wing, and the like), roll pin flange;
22 (22L, 22R): trigger guard roll pin hole (lateral hole in the flange 20);
30: hand grip retention screw hole;
32: hand grip retention screw;
34: selector (safety, fire control lever);
40: pin punch;
42: hammer;
44: pad, block, or the like;

TO: tang offset (inward offset of the trigger guard tangs 20 from the outer surfaces of the lower receiver 10);
U: User, armorer, gunsmith, repair or assembly technician, operator, maintenance personnel, aid the like.

As further understood by those having ordinary skill in the art, the conventional M16/M4/AR-15 family weapons are made to an exacting technical data description that is agreed upon by manufacturers of not only the firearms but the numerous aftermarket accessories as well; and, as such, provides interchangeability and modularity within and between manufacturers using such designation. As such, designation of the subject firearms as being within M16/M4/AR-15 family weapons provides the indication (designation) of de facto standardization of the components so designated. Thus, such designation is distinct and particular as used in connection with claims directed thereto.

During assembly and repair operations of AR-15/M16 pattern (style or family) rifles and M4 pattern (style or family) carbines (i.e., weapons), and variants thereof (referred to as guns, weapons, or firearms hereafter), the trigger guards (i.e., mechanism, assembly, devices, etc.) of such weapons, as is well known to those skilled in the art of the assembly, maintenance, and repair of the weapons, are often removed and installed (or reinstalled). Such operations may include tasks such as but not limited to initial firearm assembly, installation of new trigger guards to replace damaged trigger guards, upgrading of trigger guards, etc.

Referring to FIGS. 1-3, FIGS. 1-3 illustrate conventional, prior art AR-15/M16 rifle and M4 carbine pattern lower receivers 10. FIG. 1 is a left side elevation of a bare (stripped) lower receiver 10. The lower receiver 10 shown on FIG. 1 is intact. FIG. 2 is an isometric view from the upper, right, front with inset 2A which is an isometric view from the upper, right, rear that illustrates the user, U, using the conventional tools (i.e., the punch 40, the hammer 42, and the pad 44) during the process of trigger guard retention roll pin 14 installation or removal. FIG. 3 is an isometric view of the receiver 10 from the lower, left, rear that illustrates an example of a flange 20L that was broken during an unfortunate but all too common failed attempt to install the trigger guard retention roll pin 14.

During assembly, repair, and replacement operations of the AR-15/M16 pattern rifles and M4 pattern carbines (i.e., firearms, weapons, etc.) 10, and variants thereof, a trigger guard element 12 of the lower receiver 10 may be installed or removed. As understood by one of skill in the art, e.g., an armorer, gunsmith, user, operator, repair or assembly technician, maintenance personnel, and the like, U, the rear portion of the trigger guard 12 is held (retained) in the lower receiver 10 by a tension pin (e.g., roll pin, split pin, C pin, spiral pin, coil pin, etc.) 14 that is inserted between (driven into) lateral holes 22 (e.g., holes 22L and 22R) within laterally opposing first and second flanges (tangs, tabs, ears, etc.) 20 (e.g., ears 20L and 20R) on the lower receiver subassembly 10 of the firearm forward of the hand grip mounting region (e.g., a hand grip flange 16) and through an intervening lateral hole (channel, passage, etc.) in the rear of trigger guard 12. The most commonly used tension pin is a roll pin (split pin). As such, hereinafter, the tension pin 14 is non-exclusively referred to as a roll pin. The hand grip flange 16 includes a threaded hole 30, which matingly receives a threaded screw or bolt 32 (see, for example, FIGS. 5-7) to retain a hand (pistol) grip (not shown) as part of the assembly process, as understood by one skilled in the art.

As illustrated on FIG. 2 including inset 2A, conventional tools and a conventional process that have been used for AR-15/M16 rifle and M4 carbine 10 trigger guard roll pin 14 installation and removal include a pin punch (i.e., punch with a flat tip) 40, a hammer 42, and an impact resistant pad or block 44 that is placed behind the lower receiver 10 at the roll pin flange 20 that is opposite the side from which the roll pin 14 is inserted. The pad 44 is typically placed on a work bench or table (not shown). The user, U, manually positions the trigger guard 12, laterally aligns the roll pin 14, and drives the roll pin 14 into position through the holes 22 via taps, hits, blows, and the like to the punch 40 with the hammer 42. Alternatively (not illustrated), the roll pin 14 may also be pressed (squeezed) into position through the holes 22 (e.g., pressed using a C-clamp, pliers, or the like) laterally positioned across the roll pin tangs 20; however, the pressing of the roll pin 14 approach also has the same occasional, undesirable consequences (i.e., breakage of a roll pin flange 20, described below in connection with FIG. 3) as drying the pin 14.

Unfortunately, as illustrated on FIG. 3, even when care is taken by attempting to remove burrs, lubricate, and correctly align the roll pin 14 with both of the lower receiver flange holes 22L and 22R (and the intervening hole through the rear of the trigger guard 12) and the impact pad 44 is carefully positioned, occasionally the roll pin 14 insertion or removal process will go awry and one of the roll pin flanges 20 is broken off the lower receiver 10. As the lower receiver 10 is a costly and federally regulated (i.e., registered as a firearm) part, breaking the lower receiver 10 is a potentially costly burdensome occurrence. On FIG. 3, the distance, TO, illustrates a tang offset by which the trigger guards 20 are offset inward from the outer lateral surfaces of the receiver 10.

The broken receiver 10 may be rendered inoperable by the user and discarded. Alternatively, users who break one or both roll pin flanges 20 may: (i) repair the broken flange 20 with expensive welding, grinding, and refinish processes; (ii) repair the broken flange 20 with a relatively weak epoxy joint and hope that the broken flange 20 does not encounter any mechanical stress; or (iii) hide the broken flange 20 with a commercially available pistol grip that incorporates a trigger guard (e.g., STARK SE-1 grip, MAGFUL MIAD (registered trademark) grip) which may be costly and uncomfortable to the user. So common is the breakage of the flange 20, that the replacement grips that hide the broken roll pin flange 20 are often referred to, sometimes with Schadenfreude, as "the grip of shame". Clearly, a better approach is to not break the roll pin flange 20.

A conventional approach to avoid breaking the roll pin flange 20 is to not use a roll pin 14, instead to: tap threads or install thread adapter inserts into the holes 22, and install low profile head screws to retain the trigger guard 12. However, such an approach has the deficiencies of being expensive, requires special tools and skills to perform, may defeat the swing down ("winter", i.e., thick glove use) feature of the trigger guard 12, the trigger guard 12 may be loose (flop, wiggle), and the screws may back out unless additional steps such as adding retention compound are taken which may make removal of the screws difficult.

Thus, there is a need and a desire for a system and a process that overcomes one or more of the deficiencies of conventional devices and processes.

BRIEF DESCRIPTION OF THE INVENTION

The description herein assumes the level of knowledge held by an ordinary armorer, gunsmith, repair or assembly technician, user, operator, maintenance personnel, end the like for a conventional AR-15/M16 pattern rifle and M4 pattern carbine, and variants thereof, and the respective components and operation thereof. The description may include directional designations such as up, down, left, right, lateral, transverse, longitudinal, top, bottom, vertical, and the like, that are taken from the perspective of a firearm (e.g., a conventional AR-10/AR-15/M16 family, style, platform, or pattern rifle and M4 pattern carbine, and variants thereof) as typically held and operated by a user.

The present invention is directed to an armorer or gunsmith tool. In particular, the invention is a tool used as a trigger guard roll pin installation and removal process aid for AR-15/M16 rifles and M4 carbines. AR-15/M16 pattern rifles and M4 pattern carbines, and variants thereof, are very prolific having been produced more or less continuously since first introduced circa 1961. Such firearms are found throughout the world with millions of copies of each produced, and in use by numerous civilian personnel, and law enforcement and military agencies including use as the standard infantry firearm in much of the U.S. military. The invention is a tool that may be implemented in connection with an AR-15/M16 rifle and M4 carbine lower receiver to quickly and easily provide trigger guard retention roll pin installation and removal and prevent damage to the firearm, specifically breakage of the trigger guard retention flanges, at a relatively low cost. The invention will generally help reduce or prevent damage to components of the firearm during assembly, repair, and replacement operations.

The invention provides a secure, robust, relatively low cost trigger guard roll pin installation and removal tool for easy and convenient use in connection with a conventional AR-15/M16 pattern rifle and M4 pattern carbine firearms, and variants thereof. The invention securely mounts on a conventional lower receiver at the pistol grip mounting location (i.e., the pistol grip flange 16); and provides positive, stable support of the lower receiver flange 20 to reduce or prevent likelihood of breakage of the trigger guard pin flanges 20 during trigger guard retention pin 14 installation and removal processes. The trigger guard roll pin tool is quickly and easily removed when the desired tasks are completed. Mounting is achieved by mounting the trigger guard roll pin tool on the pistol flange 16 and securing the tool via the standard pistol grip (hand grip) screw 32 or similarly sized and threaded bolt, screw, wing bolt, or the like installed into the hand grip screw hole 30. Furthermore, the trigger guard roll pin tool may be used when the fire control selector 34 remains installed in the lower receiver 10. Thus avoiding the lost time involved with removal and re-installation of the selector 34.

For the user, U, to determine whether the roll pin 14 is driven in to the proper depth (i.e., not too shallow and not too deep) during installation, or when the roll pin 14 has been driven out during removal; techniques such as (i) visual inspection, (ii) insertion of a shim or other thin device between the tool and the flanges of the lower receiver, (iii) inspection of the length of the pin punch 40 shaft portion that extends outside of the installation guide tool, or the like can be used.

DESCRIPTION OF DRAWINGS

FIG. 13 is a sectional view taken at line 13-13 of FIG. 9; wherein FIG. 13 illustrates detail of the interior of tool of FIG. 4;

FIG. 14 is a sectional view taken at line 14-14 of FIG. 9; wherein FIG. 14 illustrates additional detail of the interior of tool of FIG. 4;

FIG. 15 a sectional view taken at line 15-15 of FIG. 9; wherein FIG. 15 illustrates additional detail of the interior of tool of FIG. 4.

DETAILED DESCRIPTION

Figure 1:
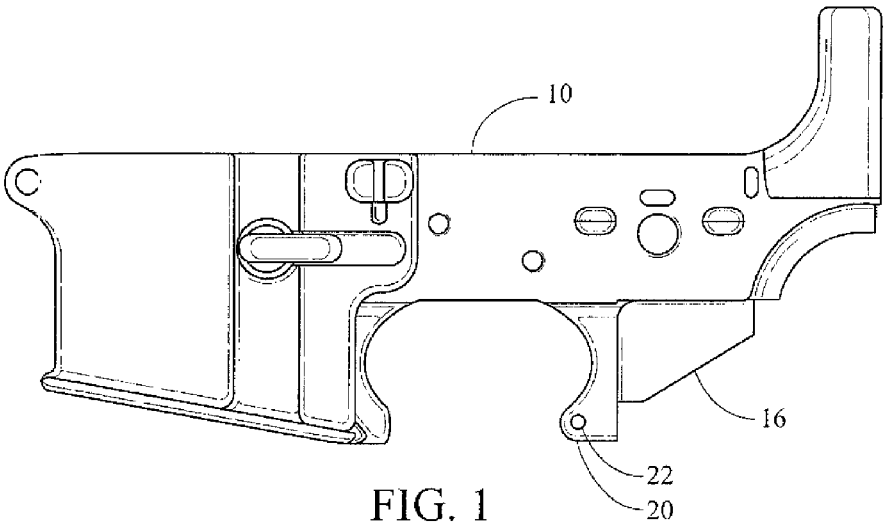
FIG. 1 (PRIOR ART)
FIG. 1 is a left side elevation view that illustrates a bare (or stripped) conventional, prior art AR-15/M16 rifle lower receiver section.
Figure 2:
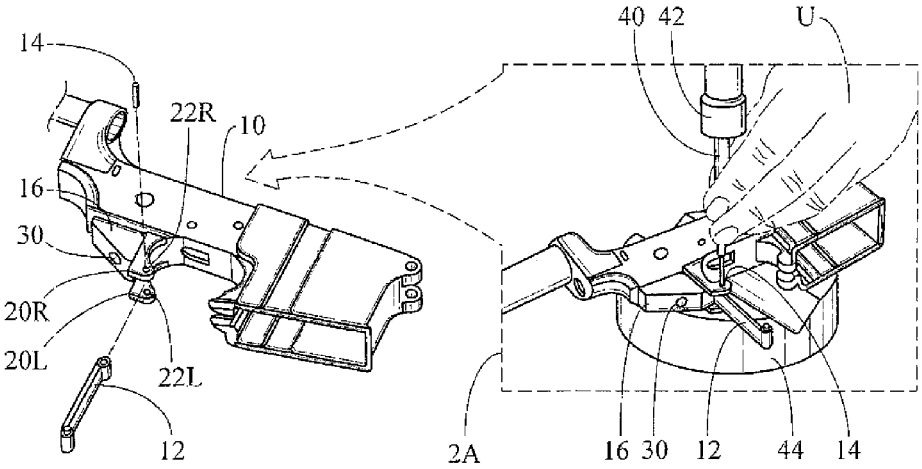
FIG. 2 (PRIOR ART)
FIG. 2 is an isometric view from the upper, right, front isometric view from the upper, right, rear with an inset 2A.
Figure 3:
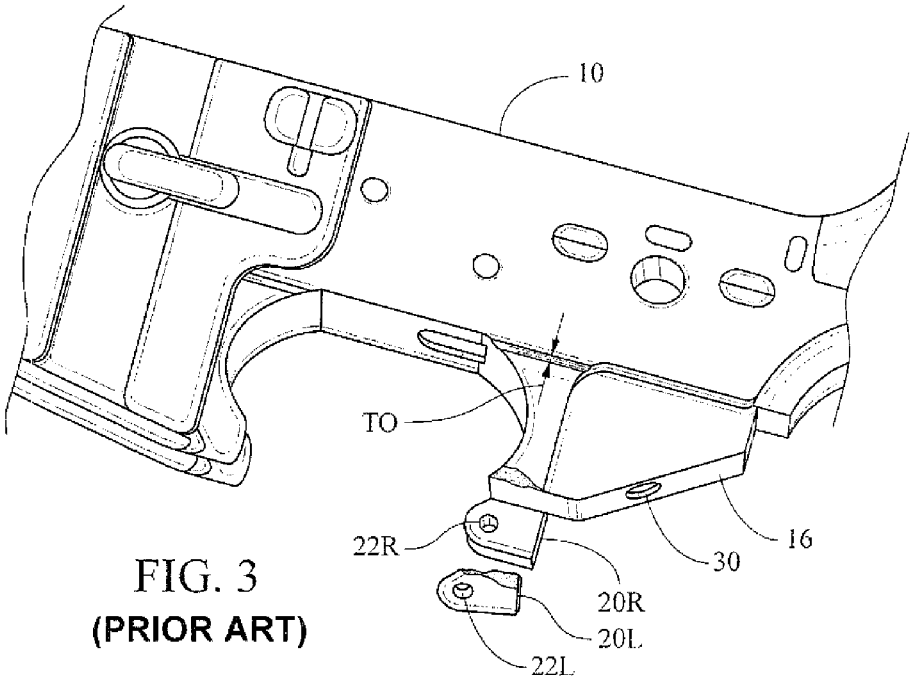
FIG. 3 (PRIOR ART)
FIG. 3 is an isometric view of a broken example of the receiver 10 from the lower, left, rear.

FIGS. 1, 2, and 3, as described above, illustrate the conventional, prior art AR-15/M16 rifle and/or M4 carbine lower receiver 10, and the use of conventional hand tools during installation and removal of the trigger guard retention roll pin 14.

The description as follows is directed to a trigger guard roll pin tool 100 (wherein elements of the tool 100 are numbered 100 and above), and includes directional designations such as up, down, left (L), right (R), lateral, transverse, longitudinal, front, forward, back/backward/rearward, top, bottom, vertical, and the like, that are generally taken from the perspective of a firearm (gun, weapon, and the like, e.g., a conventional AR-10/AR-15/M16/M4 family, style, platform, or pattern rifle and carbine, and variants thereof as typically held and operated (e.g., fired).

The description is generally related to and made in connection with the AR-15/M16 pattern (platform, style, or family) rifles and M4 pattern carbines (i.e., weapons), and variants thereof (referred to as guns, weapons or firearms hereafter). The description is generally applicable to removal and installation of the retention roll pin 14 for the trigger guard subassembly 12 (e.g., the roll pin 14), and the tool 100 may be advantageously implemented in connection with other firearms having the same or similar trigger guards. The trigger guard roll pin tool 100 is generally mounted on the lower receiver 10 in lieu of the hand grip to aid the removal and installation of the trigger guard subassembly 12. The trigger guard roll pin tool 100 generally provides a strong, secure, stable support to the trigger guard flange 20 (e.g., the trigger guard flanges 20R and 20L) the thus reducing the risk of breakage during removal and installation of the retention roll pin 14.

Elements (numbered 100 and above) of the present invention may include but are not necessarily included in all embodiments and are not limited to:

100: trigger guard roll pin tool (apparatus, device, assembly, part, and the like);
102: mounting body;
104: flange (tang, ear, wing) support;
106: spacer;
110: base (shroud);
120: grip flange cavity
124: retention screw hole;
130: roll pin passage hole;
BT: base thickness (thickness of the base 110 at the outer wall to the left of the spacer 106)
CD: total clearance distance, is the distance from the inner wall of the base 110 to the left outer edge of the receiver 10. CD=SC+SD;
R: radius, which is greater than the length of the selector 34 and thereby provides clearance
SC: clearance between the inner wall of the base 110 and the selector 34;
SD: distance that the selector 34 extends away (to the left) from the receiver 10;
TL: forward extension length of the roll pin flange 20 from the grip mounting flange 16;
TT: total thickness, is the distance from the left inner wall of the mounting body 102 to the left outer wall of the base 110.

Figure 4:
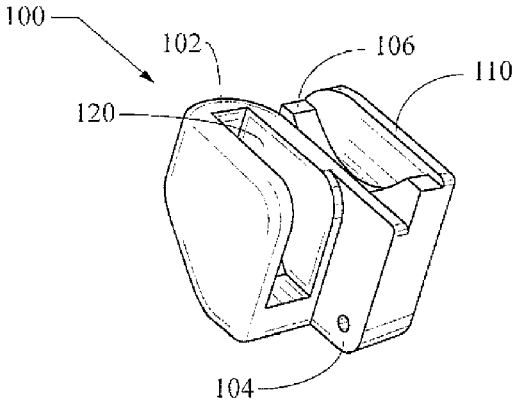
FIG. 4 is an isometric view from the left, front, upper point of view of the trigger guard roll pin tool invention.

Referring to FIG. 4, an isometric view from the left, front, upper point of view of a trigger guard roll pin tool 100 of the present invention is shown. The trigger guard roll pin tool 100 comprises a mounting body 102, and successively to the left of the mounting body 102, a flange support 104, a spacer 106 and a base 110. Alternatively (not shown) a right side mirror embodiment of the invention may be implemented instead of the left side embodiment. The right side embodiment may be preferred by left handed users.

The tool 100 is generally molded, cast and/or machined from a high (or heavy) density polyethylene (HDPE), ultra high molecular weight polyethylene (UHMWPE or UHMW), high strength nylon (e.g., Nylon 6), DELRIN, RYNITE, filled/reinforced polymer, or metal such as aluminum, steel, brass, or the like. The tool 100 may be formed as a single unit; alternatively, the tool 100 may be an assembly of two or more parts that are securely joined. However, any appropriate material and manufacturing technique (process) may be implemented to meet the design criteria of a particular application.

The roll pin tool 100 provides support to the lower receiver flange 20 to reduce or prevent likelihood of breakage of the trigger guard pin flanges 20 during the trigger guard roll pin 14 installation and removal processes. The trigger guard roll pin tool 100 is quickly and easily removed when the desired tasks are started and when completed. The mounting body 102 includes a cavity (void) 120 that is sized and shaped to provide for mounting the tool 100 on the grip mounting flange 16.

The flange support 104 is generally implemented as a step (ledge, ridge, and the like) at the front of the tool 100. The flange support 104 fits tightly against (e.g., adjacent) the flange 20L and thereby reduces or prevents flex and breakage of the ear 20L when the roll pin 14 is driven in or out of (i.e., through) the pin hole 22L. The spacer 106 spaces the base 110 away from the receiver 10 and provides clearance for the selector 34 such that the selector 34 does not have to be removed from the receiver 10. The base 110 holds the receiver 10 and provides an impact resistant surface.

Figure 5:
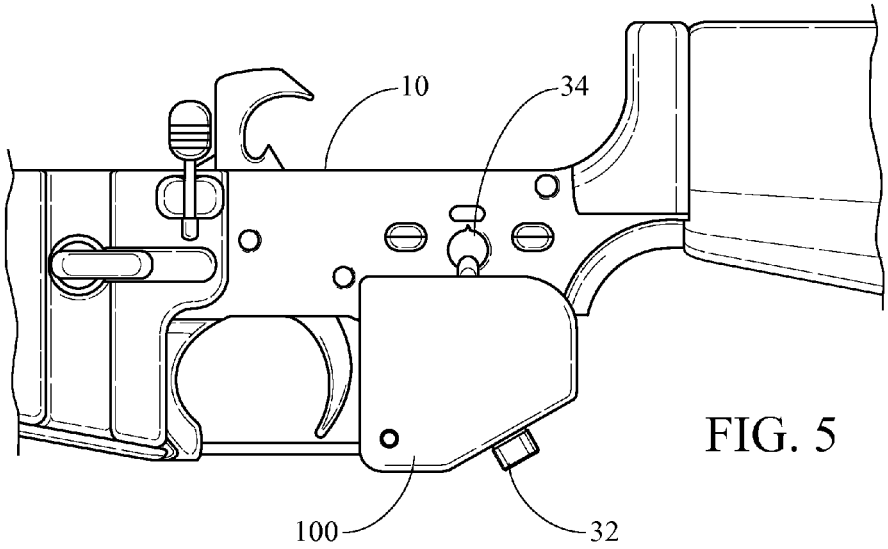
FIG. 5 is a left side elevation view that illustrates the tool of FIG. 4 as installed a conventional lower receiver at the pistol grip mounting location, and also illustrates the installation screw.

FIG. 5 is a left side view that illustrates the tool of FIG. 4 as installed the conventional lower receiver 10 at the pistol grip (hand grip) mounting location 16. FIG. 5 also illustrates the installation screw 32 which is installed through the retention screw hole 124 and into the grip screw hole 30 to threadedly secure the tool 100 to the receiver 10. When the trigger guard roll pin tool 100 is installed, no conventional pad 44 is needed (i.e., implementation of the pad 44 may be avoided). The roll pin 14 installation and removal processes can be conducted essentially as illustrated on FIGS. 2 and 2A and described above in connection therewith.

Figure 6:
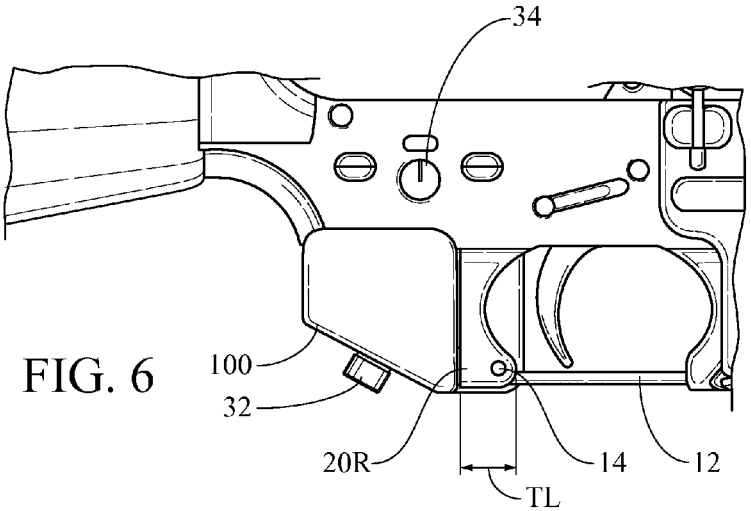
FIG. 6 is a right side elevation view that illustrates the tool of FIG. 4 as installed a conventional lower receiver at the pistol grip mounting location.

FIG. 6 is a right side view that illustrates the tool of FIG. 4 as installed. Also indicated is the forward extension length, TL, of the roll pin flange 20 from the grip mounting flange 16. The flange support 104 extends forward from the mounting body 102 by at least the forward extension length, TL, to provide support for the roll pin ear 20.

Figure 7:
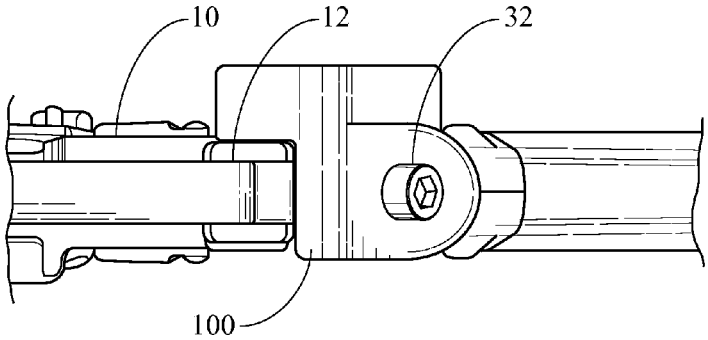
FIG. 7 is a bottom view that illustrates the tool of FIG. 4. as installed a conventional lower receiver.

FIG. 7 is a bottom view that illustrates the tool of FIG. 4 as installed.

Figure 8:
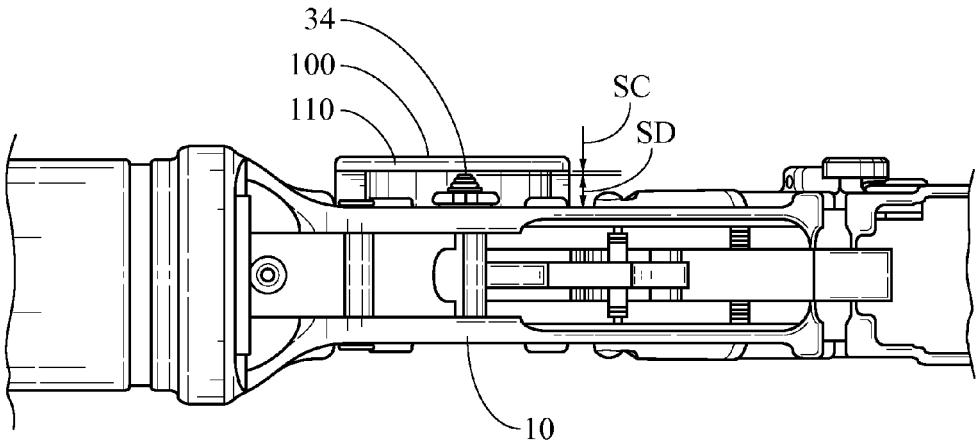
FIG. 8 is a top (plan) view of the tool of FIG. 4 as installed on a conventional lower receiver at the pistol grip mounting location and illustrates the support that the tool of FIG. 4 provides, as a well as clearance that the tool provides for the selector.

FIG. 8 is a top view that illustrates the tool of FIG. 4 as installed. FIG. 8 illustrates the support that the tool of FIG. 4 provides via the base 110, as a well as selector distance, SD, which is the distance that the selector 34 extends away (to the left) from the receiver 10; and clearance, SC, between the inner wall of the base 110 and the selector 34.

Figure 9:
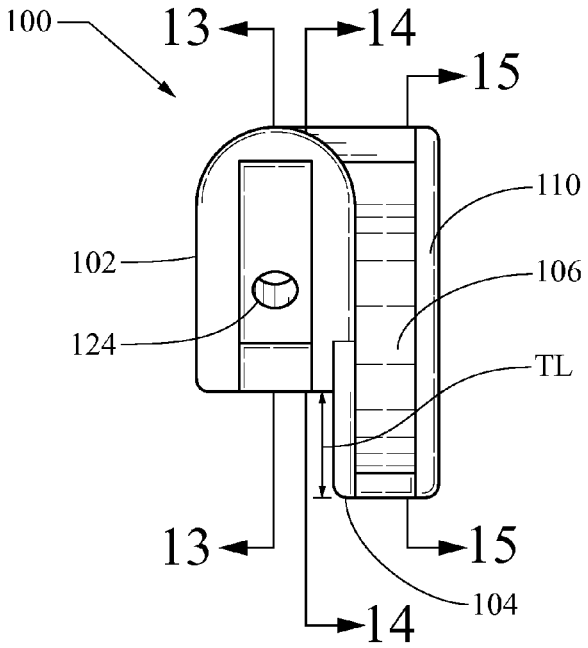
FIG. 9 is a top view that illustrates the tool of FIG. 4.

FIG. 9 is a top view of the tool of FIG. 4. The screw retention hole 124 is positioned and sized within the body 102 to align with the grip screw hole 30 and to receive the grip retention screw 32. The tool 100 is constructed such that the innermost edge of the flange support 104 fits tightly against (i.e., adjacent to) the left trigger guard flange 20L when the tool 100 is installed on the receiver 10.

Figure 10:
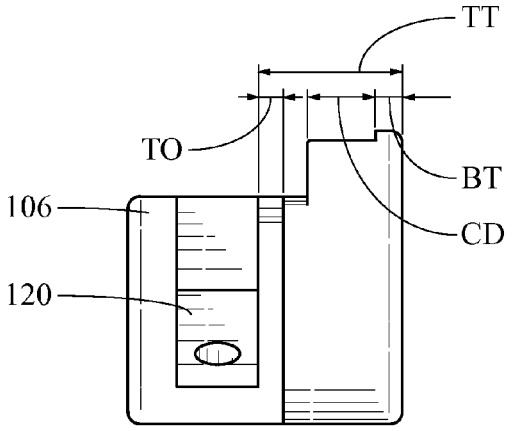
FIG. 10 is a front view of the tool of FIG. 4.

FIG. 10 is a front view of the tool of FIG. 4. The base thickness BT, is the thickness of the base 110 at the outer wall to the left of the spacer 106. The total clearance distance, CD, is the distance from the inner wall of the base 110 to the left outer edge of the receiver 10 (see also, FIG. 11). CD=SC+SD. The tang offset, TO, is the inward offset of the trigger guard tangs 20 from the outer surfaces of the lower receiver 10. The total thickness, TT, is the distance from the left inner wall of the mounting body 102 to the left outer wall of the base 110.

Figure 11:
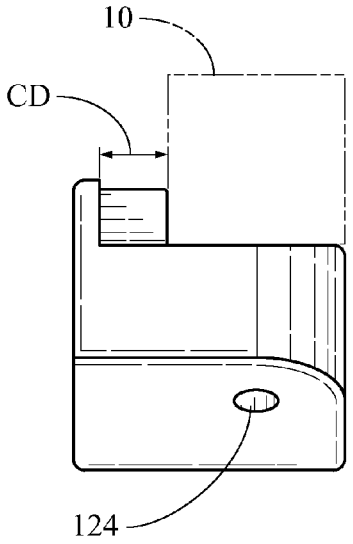
FIG. 11 is a rear view of the tool of FIG. 4.

FIG. 11 is a rear view of the tool of FIG. 4. The receiver 10 is shown in phantom to illustrate a reference for the total clearance distance, CD.

Figure 12:
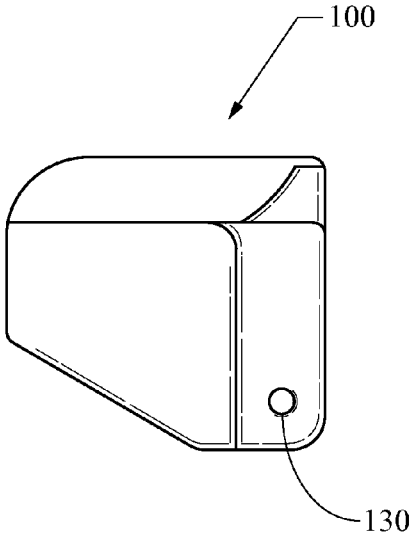
FIG. 12 is a right side elevation view of the tool of FIG. 4.

FIG. 12 is a right side elevation view of the tool of FIG. 4. The roll pin eject (clearance) hole 130 is illustrated. The roll pin eject hole 130 is horizontally and vertically positioned at a location to directly align with the roll pin hole 22L, and extends laterally through the flange support 104, spacer 106, and base 110 sections of the tool 100 and is sized having a slightly larger diameter than the roll pin holes 22. As such, during a process to remove the roll pin 14, the roll pin 14 may be readily driven (tapped) out through the trigger guard 12 and is loosely received into and through the roll pin clearance (eject) hole 130.

Figure 13:
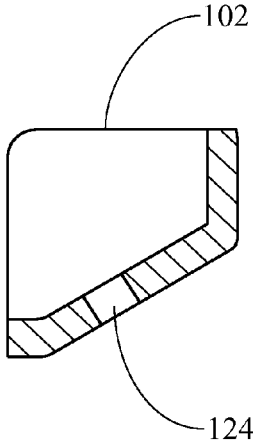

FIG. 13 is a side sectional view taken at line 13-13 of FIG. 9. FIG. 13 illustrates detail of the interior mounting cavity 120 of tool of FIG. 4. The line 13-13 is at the center of the retention screw hole 124.

Figure 14:
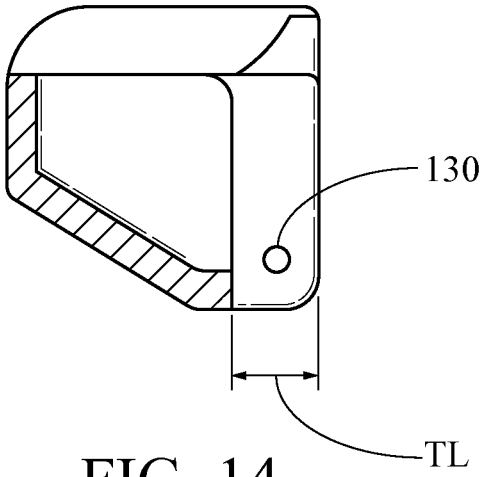

FIG. 14 is a side sectional view taken at line 14-14 of FIG. 9. FIG. 14 illustrates detail of the flange support 104 and the spacer 106. The line 14-14 is slightly interior (to the right) of the left edge of the grip flange mounting cavity 120 such that FIG. 14 illustrates the inner left edge of the cavity 120 as well as interior details of the flange support 104 and the spacer 106.

Figure 15:
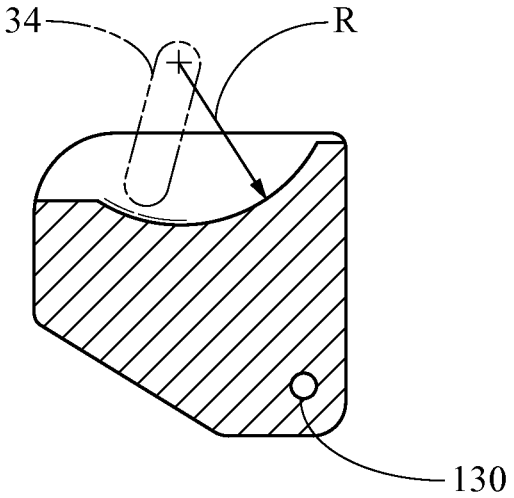

FIG. 15 is a side sectional view taken at line 15-15 of FIG. 9. The line 15-15 is interior (to the right) of the left edge of the inner wall of the base 110. FIG. 15 illustrates additional detail of the spacer 106. In particular, the spacer 106 has a radius, R, at the top that provides clearance for installation (and rotation, if desired) of the selector 34, shown in phantom. Note that the spacer 106 is not necessarily formed having a curved surface so long as adequate clearance for the selector 34 is provided.

The firearm tool 100 is generally used by a user such as an armorer, gunsmith, repair or assembly technician, maintenance personnel, and the like. However, a home (non-commercial) user may find the trigger guard roll pin tool 100 to be a useful aid as well.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A trigger guard roll pin tool (100) for use during removal and installation of a trigger guard roll pin (14) on a firearm by a user (U) using a hammer (42) and a punch (40), the firearm having a lower receiver (10) that includes a trigger guard (12) having a roll pin through hole, a left trigger guard retention flange (20L) having a left roll pin hole (22L), a right trigger guard retention flange (20R) having a right roll pin hole (22R), and a pistol grip retention flange (16) having a threaded grip screw hole (30);

a grip retention screw (32), wherein the threaded grip screw hole is configured to threadably receive the grip retention screw (32); and a selector (34) that is installed in the lower receiver (10) and extends a selector distance to the left of the left outer surface of the lower receiver (10); wherein the left trigger guard retention flange is inwardly offset from the outer left surface of the lower receiver by a tang offset distance, and extends forward of the front edge of the pistol grip retention flange by a forward extension length, and the right trigger guard retention flange is inwardly offset from the outer right surface of the lower receiver by the tang offset distance, and extends forward of the front edge of the pistol grip retention flange by the forward extension length, the trigger guard roll pin tool (100) comprising:

a mounting body (102), and successively adjacent to the mounting body, a flange support (104), a spacer (106), and a base (110); wherein the mounting body (102) is sized and shaped to fit upon the pistol grip retention flange and the mounting body (102) further comprises a retention screw hole (124), and during use to install or remove the roll pin, the tool (100) is mounted to the pistol grip retention flange (16) via the grip retention screw (32) that is installed through the retention screw hole (124); and the flange support comprises an inward step at the front of the tool in the direction of firing when the tool is installed on the firearm, and the flange support fits adjacent the left trigger guard retention flange and extends forward from the mounting body in the direction of firing when the tool is installed on the firearm by at least the forward extension length to provide support for the left trigger guard retention flange when the tool is installed on the firearm and the roll pin is driven in or out of the left roll pin hole.

2. The tool of claim 1 wherein, the spacer spaces the base away from the receiver, and provides clearance for the selector such that the selector is clear of the base and does not have to be removed from the receiver during the use to install or remove the roll pin.

3. The tool of claim 1 wherein, the tool further comprises a roll pin passage hole (130) wherein, the roll pin passage hole is horizontally and vertically positioned to directly align with the left roll pin hole when the tool is installed on the firearm, extends laterally through the flange support, the spacer, and the base, and is sized having a diameter that is larger than the left roll pin hole, such that, during the use to remove the roll pin, the roll pin is driven out through the trigger guard and is received into and through the roll pin clearance hole.

4. The tool of claim 1, wherein the tool is formed as a single, integral unit.

5. The tool of claim 1, wherein the tool is an assembly of two or more parts that are securely joined.

6. The tool of claim 1, wherein the tool is made from a high density polyethylene, ultra high molecular weight polyethylene, high strength nylon, or filled/reinforced polymer.

7. The tool of claim 1, wherein the tool is made from aluminum, steel, or brass.

8. The tool of claim 1, wherein the tool is molded, cast or machined.

9. The tool of claim 1, wherein the firearm is one of: an AR-10, an AR-15, an M16, an M4 carbine, an M16 family rifle, or an M4 variant rifle.

* * * * *